United States Patent [19]

Güthling et al.

[11] Patent Number: 4,641,576

[45] Date of Patent: Feb. 10, 1987

[54] CLAMPING DEVICE FOR PRINTING PLATES AND PRINTING CLOTHS ON PRINTING MACHINES

[75] Inventors: Klaus Güthling; Adolf J. Meyer; Manfred Miethe, all of Lüneburg, Fed. Rep. of Germany

[73] Assignee: Fa. Wilhelm Barenschee, Luneberg, Fed. Rep. of Germany

[21] Appl. No.: 817,936

[22] PCT Filed: Apr. 26, 1985

[86] PCT No.: PCT/EP85/00188

§ 371 Date: Dec. 3, 1985

§ 102(e) Date: Dec. 3, 1985

[87] PCT Pub. No.: WO85/05075

PCT Pub. Date: Nov. 21, 1985

[30] Foreign Application Priority Data

May 2, 1984 [DE] Fed. Rep. of Germany ..... 3416187

[51] Int. Cl.[4] ..... B41F 27/06; B41F 7/22

[52] U.S. Cl. ..... 101/415.1

[58] Field of Search ..... 101/415.1, 378

[56] References Cited

U.S. PATENT DOCUMENTS

| | | | |
|---|---|---|---|
| 2,720,673 | 11/1948 | Fischer | 101/415.1 |
| 3,382,799 | 5/1968 | Luehrs | 101/415.1 |
| 3,771,449 | 11/1973 | Hill | 101/415.1 |
| 3,941,055 | 3/1976 | Semmler et al. | 101/378 X |
| 4,108,069 | 8/1978 | Standiford | 101/415.1 |

FOREIGN PATENT DOCUMENTS

| | | | |
|---|---|---|---|
| 1075635 | 9/1954 | Fed. Rep. of Germany | 101/415.1 |
| 2606223 | 8/1977 | Fed. Rep. of Germany | 101/415.1 |

*Primary Examiner*—J. Reed Fisher

*Attorney, Agent, or Firm*—Sughrue, Mion, Zinn, Macpeak and Seas

[57] ABSTRACT

Clamping device for cylinders on printing machines for tensioning flexible printing plates or printing cloths, which at their ends are provided with chamferings or angle stiffeners for fastening to a slotted shaft, the shaft being tensioned by means of a torque bar spring. The shaft (10) comprises two opposed slots (11, 12) (FIG. 1).

1 Claim, 4 Drawing Figures

FIG. 1
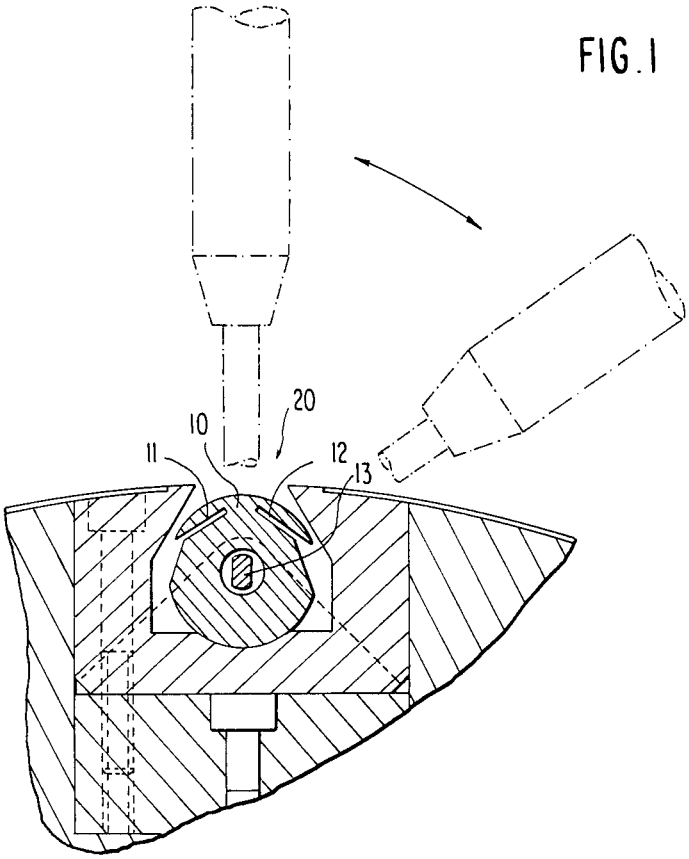
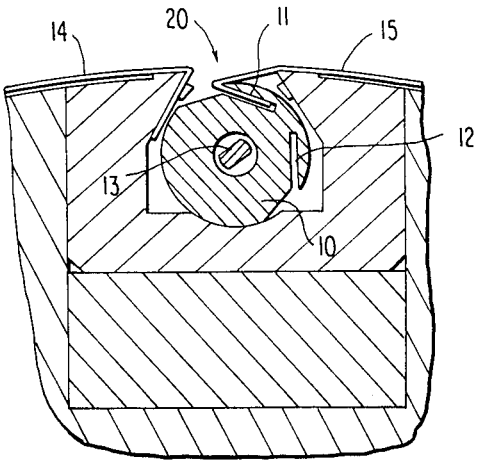
FIG. 2

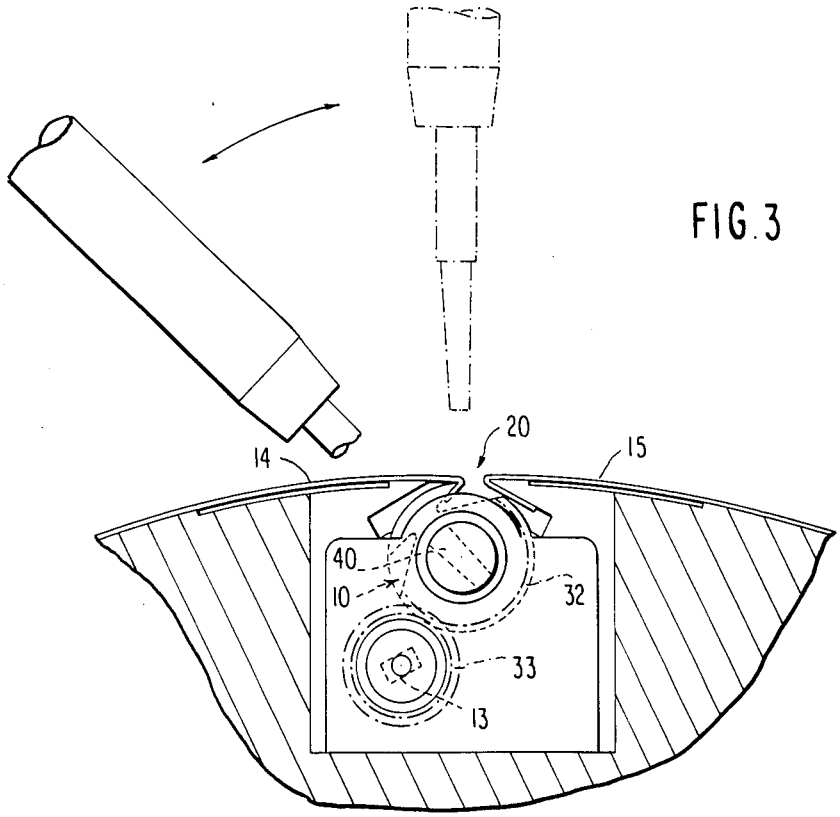
FIG. 3
FIG. 4
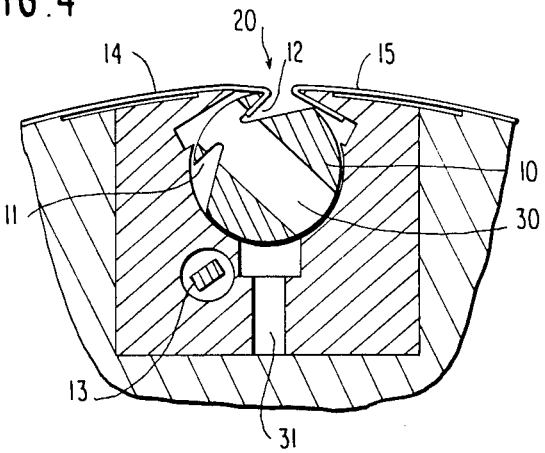

CLAMPING DEVICE FOR PRINTING PLATES AND PRINTING CLOTHS ON PRINTING MACHINES

The invention relates to a clamping device for cylinders on printing machines for flexible printing plates or printing cloths, which at their ends are provided with chamferings or angle stiffeners which can be attached to a slotted shaft, which is biased by means of a torque bar spring.

Known cylinders contain in their interior clamping means for printing plates. These relatively large-sized clamping means, owing to the weakening of the effective cross-section of the cylinder, reduce the rigidity of the cylinder, so that during the printing operation the truth of rotation will be impaired. Known methods for the quick lockup of printing plates to printing cylinders, although indeed permitting a quick lockup, tolerate the lower quality of the prints produced owing to the lower rigidity of the plate cylinder.

When using printing plates consisting of a metal substrate (steel, aluminum or the like) or of an appropriate synthetic material and a photopolymer layer, the printing plate itself is fixed on the saddle plate. Such devices are known (DE-PS 22 07 138).

It may happen that depending from the use of the plate cylinders the rotation of the plate cylinder in the one or the opposite direction is desired. When in such a case printing plates are to be mounted, it will be critical that the tension shafts have the correct position in the recess of the plate cylinder, namely so that the head of a printing plate can be locked in the correct direction. Had the tension shaft not been mounted in this manner the entire unit comprising the torque bar spring and also the tension shaft, must be pulled out and-remounted after a 180° turn.

The invention therefore deals with the problem of avoiding such actually undesirable re-rigging.

The solution of this problem is provided by a plate cylinder assembly according to the claim.

By means of a shaft slotted in two directions it is at all times possible to mount a printing plate in such a manner that the direction of rotation corresponds to the lockup. Simultaneously there can be adjusted the required bias since, as is known, a torque bar spring can be stresses both in the one and the other direction of rotation.

The clamping device according to the invention has the advantage that the printing plates are constantly tensioned during the printing operation in circumferential direction by means of the action of force of the torque bar spring. For the problem as to how the clamping device should be attached to the plate cylinder two alternatives are available. The clamping device could be mounted by means of inner hexagon cap screws being screwed from the outer circumference into the plate cylinder. In this case, however, the countersunk space for the cap of the screw must be filled with a plug of synthetic material. But later, when the unit should be disassembled, it is very cumbersome to remove the plastic plug again. Therefore there is in an embodiment of the clamping device according to the invention the clamping device itself attached on the printing cylinder with a screw which is located in the interior of the clamping device. However, at this position the screw would be inaccessible if the shaft itself were not provided with a through-bore of appropriate size.

The invention is described by way of example with reference to the drawing, in which FIG. 1 shows a cross-sectional view through a clearance in a plate cylinder assembly with a tension shaft according to the invention.

FIG 2 shows at an enlarged scale a corresponding illustration including printing plates in the lockup position.

FIG. 3 shows a modified embodiment of a clamping device according to the invention.

FIG. 4 shows details of the clamping device shown in FIG. 3.

In the figures, 20 designates the recess in a plate cylinder. Into this recess fits a unit or the device, respectively, designated as a whole as clamping device. The clamping device comprises a shaft 10 and the torque spring 13. The tension shaft according to the invention is provided with two slots 11 and 12, which are disposed symmetrically to the central position of the shaft. By 20 is designated the opening through which access to the tension shaft is possible. Two printing plates are designated by 14 and 15 which comprise at their ends angle stiffeners which can be fixed to appropriate parts. The one end is attached directly to the printing cylinder, while the other end is secured in one of the slots 11 or 12 of the slotted shaft 10.

In FIG. 1 can also be seen that by means of suitable tools and by a pivoting motion the shaft 10 can be pivoted against the action of force of the torque bar spring 13.

In FIG. 1 is shown on the left side the screw by means of which the clamping device is fastened on the printing cylinder.

FIGS. 3 and 4 show a modified embodiment of the invention in which identical parts are given the same reference numerals.

In FIG. 4 is shown a shaft 10 which comprises a through-bore 30. With the shaft being in the central position 10, it is possible with a suitable tool to turn through this through-bore 30 a screw located in a sunk bore 31 and fixing the clamping device to the printing cylinder.

In FIG. 3 it is shown how the force of the torque bar spring 13 can be transmitted onto shaft 10. For this purpose a gear wheel or toothed segment 32 is fixed to the shaft, which meshes with another gear wheel 33. Gear wheel 33 is fixed to the one end of torque bar spring 13. It is evident that in this manner by means of a tool introduced in a bore 40 a tension of the shaft can be brought about via torque bar spring 13 and the gear wheel parts 32 and 33. Usually no reduction of forces between gear wheels 32 and 33 is required, but it is possible to select a smaller diameter for gear wheel 33 to achieve in this way a spatially more favourable embodiment.

What is claimed is:

1. A clamping device for holding and tensioning one end of a flexible printing plate wrapped around the outer surface of a rotatable printing cylinder, said one end of the plate defining a reverse bent, acutely angled, stiffened edge, said device comprising:

(a) an elongate, axially bored shaft (10) rotatably disposed in a longitudinal recess (20) extending inwardly from the outer surface of the cylinder and axially parallel thereto, (b) a pair of elongate chordal slots (11, 12) extending inwardly from opposite sides of the shaft and towards each other at an obtuse angle having an apex oriented towards an outer surface of the shaft and away from the axial bore thereof, said slots:

(1) terminating short of an intersection therebetween, (2) having parallel opposite sidewalls to define constant slot widths, and (3) said slot widths being sufficient to closely accommodate a reverse bent stiffened edge of a printing plate, and (c) a torque bar (13) disposed in the shaft bore and operatively coupled to the shaft for biasing said shaft towards a neutral position whereat the slots are symmetrically disposed on opposite sides of a radius of the cylinder passing through the shaft axis such that a printing plate stiffened edge may be inserted into a slot from either side of the shaft upon the rotation thereof against the biasing force of the torque bar and the plate thereafter tensioned against the cylinder surface to thus accommodate the rotation of the cylinder in either direction during a printing operation.

* * * * *